US007878444B2

(12) United States Patent
Friesen et al.

(10) Patent No.: US 7,878,444 B2
(45) Date of Patent: Feb. 1, 2011

(54) TWO ROLL TOILET TISSUE DISPENSER

(75) Inventors: Matthew Friesen, White Rock (CA); Bradley Friesen, Vancouver (CA); John Friesen, Vancouver (CA); Andrew Jackman, Langley (CA); Alexander Tramploski, Richmond (CA)

(73) Assignee: Dispensing Dynamics International, Ltd., Surrey (CA)

( * ) Notice: Subject to any disclaimer, the term of this patent is extended or adjusted under 35 U.S.C. 154(b) by 235 days.

(21) Appl. No.: 12/110,586

(22) Filed: Apr. 28, 2008

(65) Prior Publication Data

US 2009/0266928 A1 Oct. 29, 2009

(51) Int. Cl.
*B65H 19/10* (2006.01)

(52) U.S. Cl. ..... 242/559.4; 242/560; 242/561; 242/588.6

(58) Field of Classification Search ..... 242/558, 242/559, 560, 561, 588, 588.3, 588.6, 591, 242/597, 597.8, 563.2, 559.4, 559.3, 560.3
See application file for complete search history.

(56) References Cited

U.S. PATENT DOCUMENTS

| | | | | |
|---|---|---|---|---|
| 3,211,504 | A | 10/1965 | Bump | |
| 3,214,014 | A | 10/1965 | Perrin | |
| 3,381,909 | A | 5/1968 | Tucker et al. | |
| 3,387,902 | A | 6/1968 | Perrin et al. | |
| 3,770,222 | A | 11/1973 | Jespersen | |
| 3,948,454 | A * | 4/1976 | Bastian | 242/560.3 |
| 4,340,195 | A * | 7/1982 | DeLuca | 242/560 |
| 4,662,664 | A | 5/1987 | Wendt et al. | |
| 5,628,474 | A | 5/1997 | Krueger et al. | |
| 5,865,395 | A | 2/1999 | Wei | |
| 5,868,335 | A * | 2/1999 | Lebrun | 242/560.3 |
| 5,873,542 | A | 2/1999 | Perrin et al. | |
| 5,954,256 | A | 9/1999 | Niada | |
| 6,145,779 | A | 11/2000 | Johnson et al. | |
| 6,202,956 | B1 | 3/2001 | Grasso et al. | |
| 6,237,871 | B1 | 5/2001 | Morand et al. | |
| 6,508,432 | B2 * | 1/2003 | Krivulin | 242/560.3 |
| 7,182,288 | B2 | 2/2007 | Denen et al. | |
| 2008/0078855 | A1 * | 4/2008 | Forman et al. | 242/560 |

* cited by examiner

*Primary Examiner*—William E Dondero
(74) *Attorney, Agent, or Firm*—Dwayne E. Rogge; Hughes Law Firm, PLLC

(57) ABSTRACT

A two-roll dispenser is disclosed for a plurality of rolls of products, in one embodiment a plurality of toilet paper rolls. The operation of resetting the device to accept replacement rolls of product is achieved by opening the casing. The seer mechanism is also disclosed maintaining a secondary roll of product in a reserve position until a primary roll of product is substantially consumed. In one form, rolls of product having a partial or split core are utilized to achieve the objects of this disclosure.

14 Claims, 17 Drawing Sheets

TWO ROLL TOILET TISSUE DISPENSER

BACKGROUND OF THE DISCLOSURE a) Field of the Disclosure

This disclosure relates to the field of dispensing sheet product, and in particular to dispensing rolls of toilet tissue. One form of the disclosure pertains to dual-roll dispensers were in a plurality of rolls of product are disposed on a plurality of cores. In one specific example, the disclosure relates to dispensers wherein a primary roll is at a fixed position and a secondary roll is repositioned from a reserve position to a usable position when a primary roll is substantially consumed.

b) Background Art

Several dual-roll paper product dispensers have been conceived. These prior art references have varying degrees of applicability, varying degrees of success in restricting access to a secondary roll until a primary roll is substantially consumed, and often require many steps to gain access to consumed rolls to facilitate restocking.

SUMMARY OF THE DISCLOSURE

The embodiment of this disclosure is a paper product dispenser in one form, particularly a dispenser for two separate rolls of toilet tissue. While such dual roll toilet tissue dispensers have previously been conceived, the embodiments disclosed herein utilize a novel mechanism and overcome particular disadvantages of the prior art.

To reduce waste and frequency with which the toilet paper rolls in a multiple-roll dispenser must be replaced, it is desired that the rolls of product be completely consumed before a user is able to access a secondary roll of product. Thus it is conceived that the dispenser utilize a primary roll of product which is accessible to a user, and a secondary roll of product which is only accessible to a user after the primary roll of product is substantially or completely consumed. This is accomplished by utilizing a swing arm which extends from a portion of the casing holding both rolls of product wherein the swing arm engages the outer surface of the primary roll of product. Once the primary roll of product is consumed, a portion of the swing arm repositions radially past the core of the primary roll of product, thus engaging a seer or release latch which releases the secondary roll of product from a reserve position to a position where it is accessible to a user.

In one form, the dispenser includes a casing which is pivotally mounted to a frame. A mechanism is disclosed wherein upon opening this casing about the pivot point, the mechanism resets the swing arm, the seer latch, and/or a secondary roll support which normally supports the secondary roll of product. By utilizing this mechanism which partially or totally resets the dispenser to allow a replacement primary roll of product and/or a replacement secondary roll product, time and effort can be saved by the service personnel responsible for replacing said product. This may function to save time and in turn would function to save overall costs to the business. This also frees up the service personnel for more important duties.

A paper product dispenser for dispensing toilet paper rolls in one form is disclosed utilizing a primary roll having an outer surface and a secondary roll. In one form, the dispenser includes a lateral extension having a face side, a back side, and a first end. The lateral extension is coupled at the first end to the face side of the frame and extends therefrom. A primary roll support is fixedly coupled to the lateral extension and extends transversely from the face of the lateral extension.

The primary roll support is operatively configured to support a primary roll of product. A secondary roll support is movably coupled to a vertical channel disposed on the lateral extension wherein the secondary roll support extends transversely from the face of the lateral extension. The secondary roll support comprises a release latch, and a swing arm extending transversely from the lateral extension. The swing arm may be configured to engage the outer surface of the primary roll positioned upon the primary roll support, and reposition toward the center of the primary roll of product as it is consumed. The paper product dispenser may also be configured wherein the swing arm extends transversely from the upper member through a surface defining a channel disposed upon the lateral extension.

In another embodiment the swing arm is operatively configured to be repositioned from a first position to a reserve position. As the swing arm repositions, the secondary roll support repositions from a first position to a reserve position. This repositioning allows a user access to the secondary roll of product.

Alternatively, the paper product dispenser is configured such that the swing arm is rotatably coupled to the frame at a first end of the lower member via a lower member pivot. As such, the lower member comprises a channel substantially at a second end of the lower member configured to slidably engage the upper member. In this way, the channel of the lower member directly engages the swing arm.

In one form, the swing arm is coupled to the frame and is configured to engage the outer surface of a primary roll of product while the primary roll is being utilized. The swing arm is further coupled to the casing and is operatively configured to reset to a first position when the casing is opened. The swing arm may also include an engagement portion. This engagement portion is operatively configured to engage the outer surface of the primary product roll until the primary product roll is substantially consumed. When the primary roll is consumed, the seer latch is released, and the secondary product roll is repositioned in a usable position.

The paper product dispenser may also be configured such that the casing is rotatably attached to the frame at a casing pivot. This embodiment further includes a repositioning tab which is operatively configured to engage a repositioning surface on the first end of the lower member when the casing is opened to a substantially fully open position. In this way, pressure against the repositioning surface of the lower member by the repositioning tab will rotate the lower member about the lower member pivot. This rotation will reposition the swing arm from the reserve position to the first position and functionally reset this part of the dispenser.

The paper product dispenser may also be arranged such that rotating the lower member about the lower member pivot will in turn in turn rotate the upper member about the upper member pivot. This will tend to rotate the lifting member about the lifting member pivot, which will in turn engage the engagement surface of the lifting member against the vertically sliding member. This action will reposition the secondary roll support into a reserve position, functionally resetting this part of the dispenser.

The paper product dispenser may also include an upper member which is rotatably coupled to the back side of the lateral extension. This upper member can utilize a cam surface which slidably engages the release latch. The upper member uses a cam surface, and a seer point is configured to slidably engage the seer latch while the primary product roll is not substantially consumed.

In one form, the paper product dispenser is disclosed wherein the swing arm further includes an engagement portion. This engagement portion is operatively configured to release the seer latch and the vertically sliding member, and thus releases the secondary roll product roll to an operational position. This only happens once the primary roll is completely utilized. In another embodiment, the paper product dispenser includes a secondary roll support base having a first face having an extension which is substantially configured to fit within the partial core of the product roll and support the secondary product roll. The secondary roll support base further includes a second face configured to slidably engage the face of the lateral extension. Additionally, the paper product includes a lifting member which is coupled at a first end to a lifting member pivot. This lifting member pivot extends from the lateral extension and includes an engagement surface which is substantially positioned at the second end of the lifting member and which is operatively configured to slidably engage the vertically sliding member, and comprises a surface defining a channel positioned between the lifting member pivot and the engagement surface operatively configured to engage in a sliding bar extending transversely from the upper member.

The paper product dispenser for dispensing product disposed on a plurality of hollow cores may also be configured such that the dispenser comprises a seer mechanism which is coupled to the secondary roll support and is operatively configured to reposition the secondary roll support from a reserve position to a usable position. This is accomplished only when a primary roll of product is substantially consumed. The seer mechanism may be coupled to the casing and may be operatively configured to reset from a usable position to a reserve position when the casing is substantially opened. This functionally resets this portion of the dispenser. Additionally, a swing arm may be coupled to the seer mechanism and configured to engage the outer surface of the primary roll while the primary roll is being utilized. This swing arm may be operatively configured to engage the seer mechanism and release the secondary roll support when the primary roll is substantially consumed.

A lower member may be coupled to the frame and engage a portion of the casing. The lower member is configured to reposition the swing arm when the casing is substantially opened.

A method for restocking the paper supply dispenser is disclosed, including the steps of first, opening the casing of the dispenser. The casing is configured to automatically reset the secondary roll support and/or the release latch automatically as the casing is opened. Next, any remaining cores on the primary roll support must be removed. Then, the consumed core is replaced with a substantially full roll of product; and lastly, the casing of the dispenser is closed. Additionally, a user may replace the consumed secondary roll core with a substantially full roll of product. Alternatively, the full roll of product placed upon the primary roll support is the remainder of the product left on the core previously engaged upon the secondary roll support.

DESCRIPTION OF THE PREFERRED EMBODIMENTS

Figure 1:
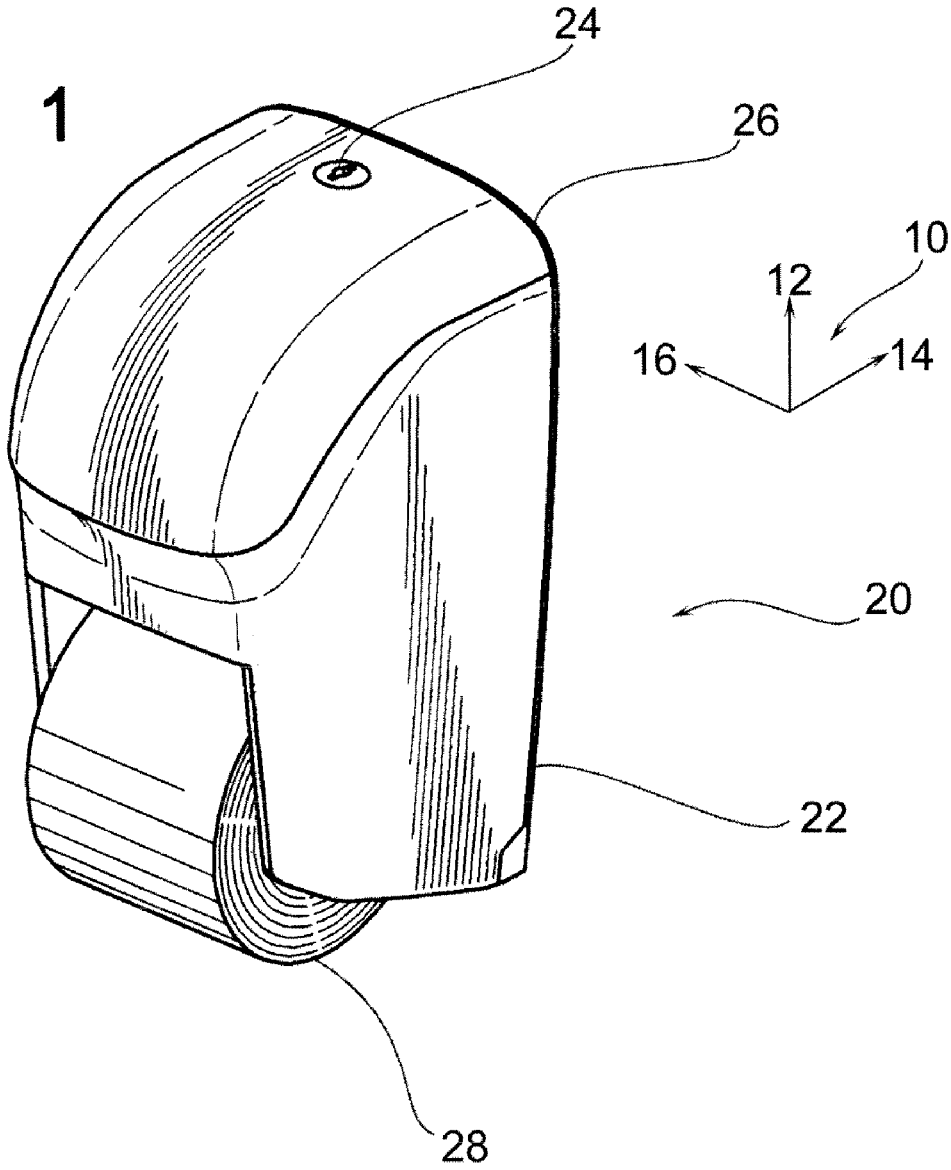
FIG. 1 is an isometric view of one embodiment of the disclosure in a closed and operational position.
Figure 2:
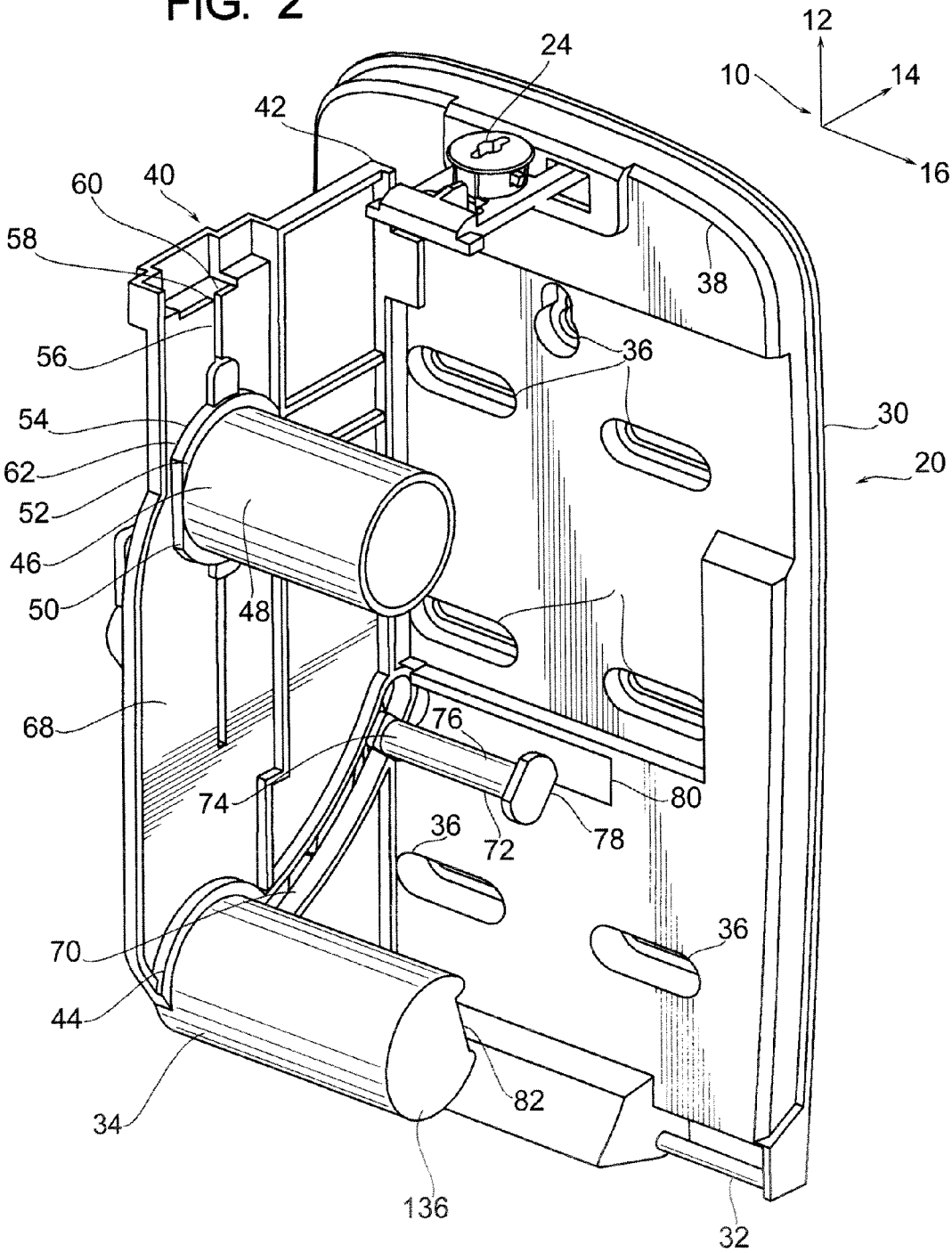
FIG. 2 is an isometric view of one embodiment of the disclosure with the casing and product rolls removed to show the mechanism.

To simplify the description and improve understanding, an axes system 10 is disclosed in FIG. 1 and again in FIG. 2 showing a vertical axis 12, a lateral axis 14, and a transverse axis 16. The arrow indicated at 12 generally shows an upward vertical direction as the arrow at 16 generally shows a rightward direction. Of course, this axis system and disclosed orientations are for understanding of the apparatus and should in no way be construed as limiting.

Looking at FIG. 1 is shown one embodiment of a dispenser 20, including a casing 22 and a latching mechanism 24. As shown, the dispenser 20 is in the closed position and is ready for operation. The back side 26 of the casing 22 could be attached to a structure such as a wall or door. A product roll 28 is shown which in one form is a roll of toilet paper. Obviously, the dispenser 20 can be scaled to fit other rolls such as paper towels or the like.

FIG. 2 shows the dispenser 20 in one form with the casing 22 and product roll 28 removed. The casing 22 in one form could normally be rotatably attached to the frame 30 at the casing pivot 32. In one form the casing pivot 32 is at the vertically lowermost extreme of the frame 30. The product roll 28 of FIG. 1 could be disposed upon the primary roll support 34. As previously mentioned, a latching mechanism 24 is shown at the vertically upward portion of the frame 30. As such latching mechanisms are known in the art, many such latching mechanisms could be made to operate as desired. A plurality of mounting holes 36 are shown which could be utilized to couple the frame 30 to a structure such as a wall or door.

One embodiment of the frame 30 includes a face side 38. Attached to the face side 38 of frame 30 is a lateral extension 40. The lateral extension is substantially a vertical wall-like structure having a first end 42 coupled to the face side 38 of frame 30. The lateral extension 40 may be coupled to the face side 38 by way of frictional engagements, adhesive, or may conceivably be formed as a unitary structure. The lateral wall extension 40 provides a structure for supporting the primary roll support 34. The primary roll support 34 may be formed as part of the lateral extension 40 or may be attached thereto by way of frictional engagements or adhesives. A plurality of gussets 44 may be provided to add rigidity to the lateral extension 40 where the primary roll support 34 couples thereto.

Figure 3A:
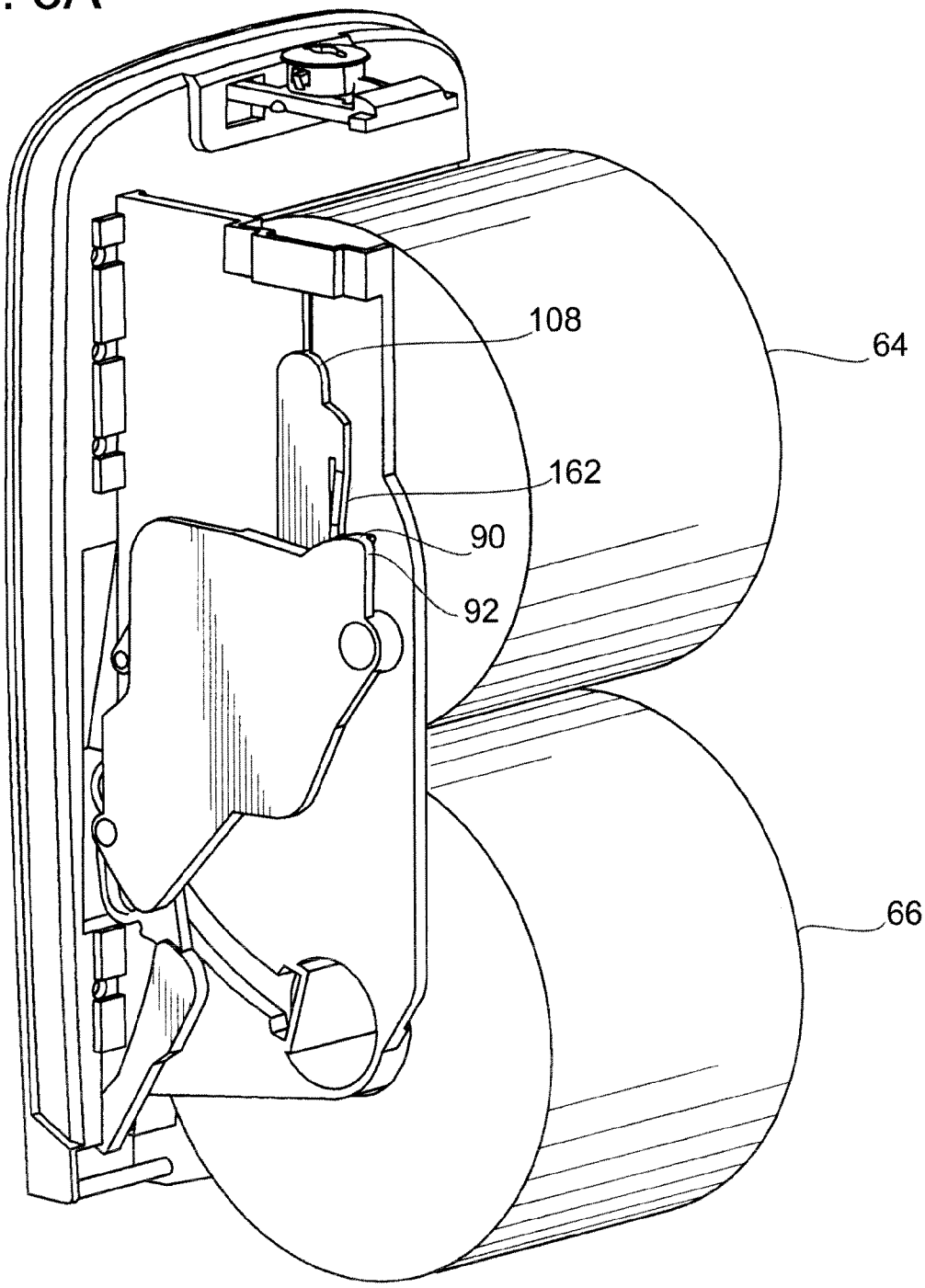
FIG. 3A is an isometric view of one embodiment of the disclosure with the casing removed and the primary and secondary product rolls in place and complete.
Figure 3B:
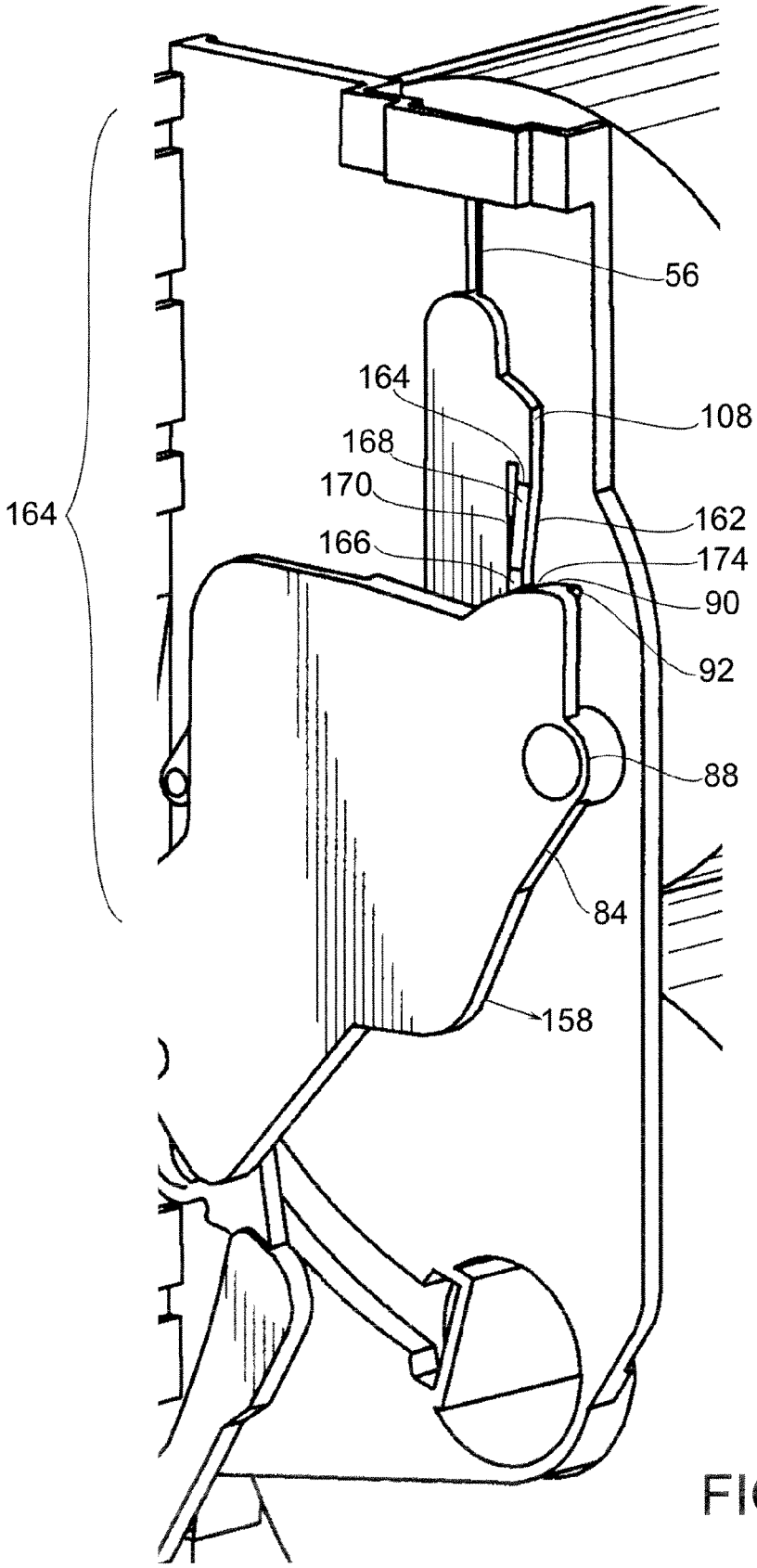
FIG. 3B is a detail view of a release mechanism of FIG. 3A.
Figure 4:
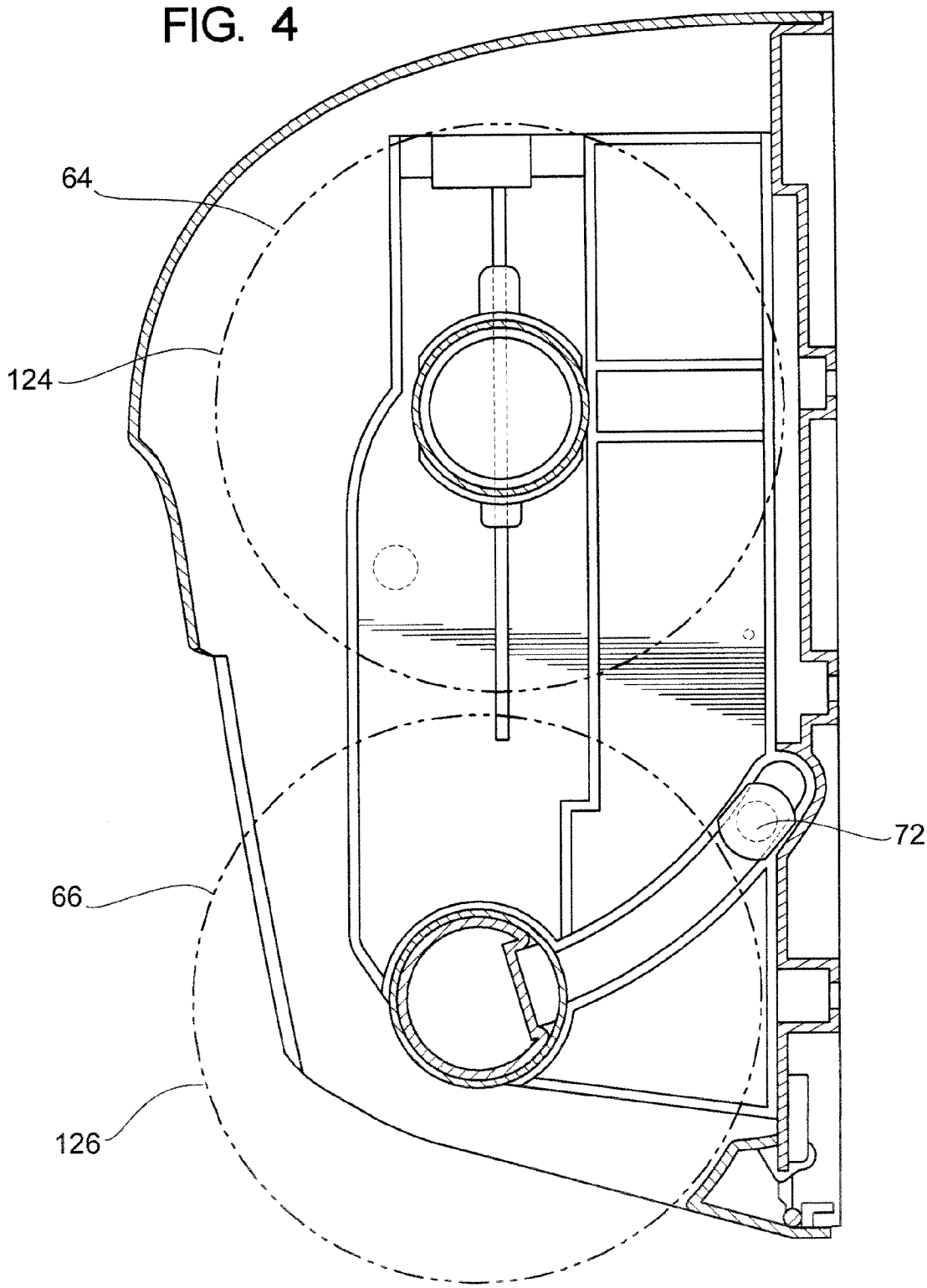
FIG. 4 is a cutaway side view of the left side of one embodiment of the disclosure in a closed and operational position with deep primary and secondary rolls complete.

A secondary roll support 46 is also provided in one form which extends transversely from the lateral extension 40 and in one form is substantially a cylinder. The secondary roll support 46 includes an extension 48 which is coupled to a secondary roll support base 50 at a first end 52. The secondary roll support base 50 further includes a second face 54 which frictionally and slidably engages the lateral extension 40 at a vertical channel 56. The vertical channel 56 is comprised of a plurality of surfaces 58 and 60, disposed within the lateral extension 40. As shown in FIG. 2, the secondary roll support 46 is in a reserve position 62 wherein it is configured to support a secondary product roll 64 as shown in FIG. 3A. Similarly, the primary roll support 34 is configured to support a primary product roll 66. Still referring to FIG. 2, the second face 54 of the secondary roll support 46 engages the lateral extension 40 on a face side 68 of the lateral extension 40. A plurality of surfaces defining a channel 70 are also disposed in the lateral extension 40 configured to allow passage and movement of a swing arm 72. The swing arm 72 having a first end 74 substantially close to the face side 68 of lateral extension 40, and a second end 76 substantially distant from the face 68 of lateral extension 40. The swing arm 72 furthermore has an engagement portion 78 configured to ride on the outer surface of the primary product roll 66 as the primary product roll 66 is being used. The frame 30 may also include a recess 80 configured to accept the swing arm 72 when it is in position furthermost from the primary roll support 34.

The primary roll support 34 of one embodiment may also include a channel 82 configured to receive a portion of the swing arm 72 when the swing arm 72 is in position closest to the primary roll support 34. As will be discussed later, when a primary product roll 66 is used having a partial or split core as is known in the art, the engagement portion 78 of the swing arm 72 will ride along on the outer portion of the primary product roll 66 until the primary product roll 66 is substantially consumed at which point the engagement portion 78 will press past the end of the partial core and set substantially within or beyond the channel 82. The end result of this operation will be discussed in detail.

Figure 6:
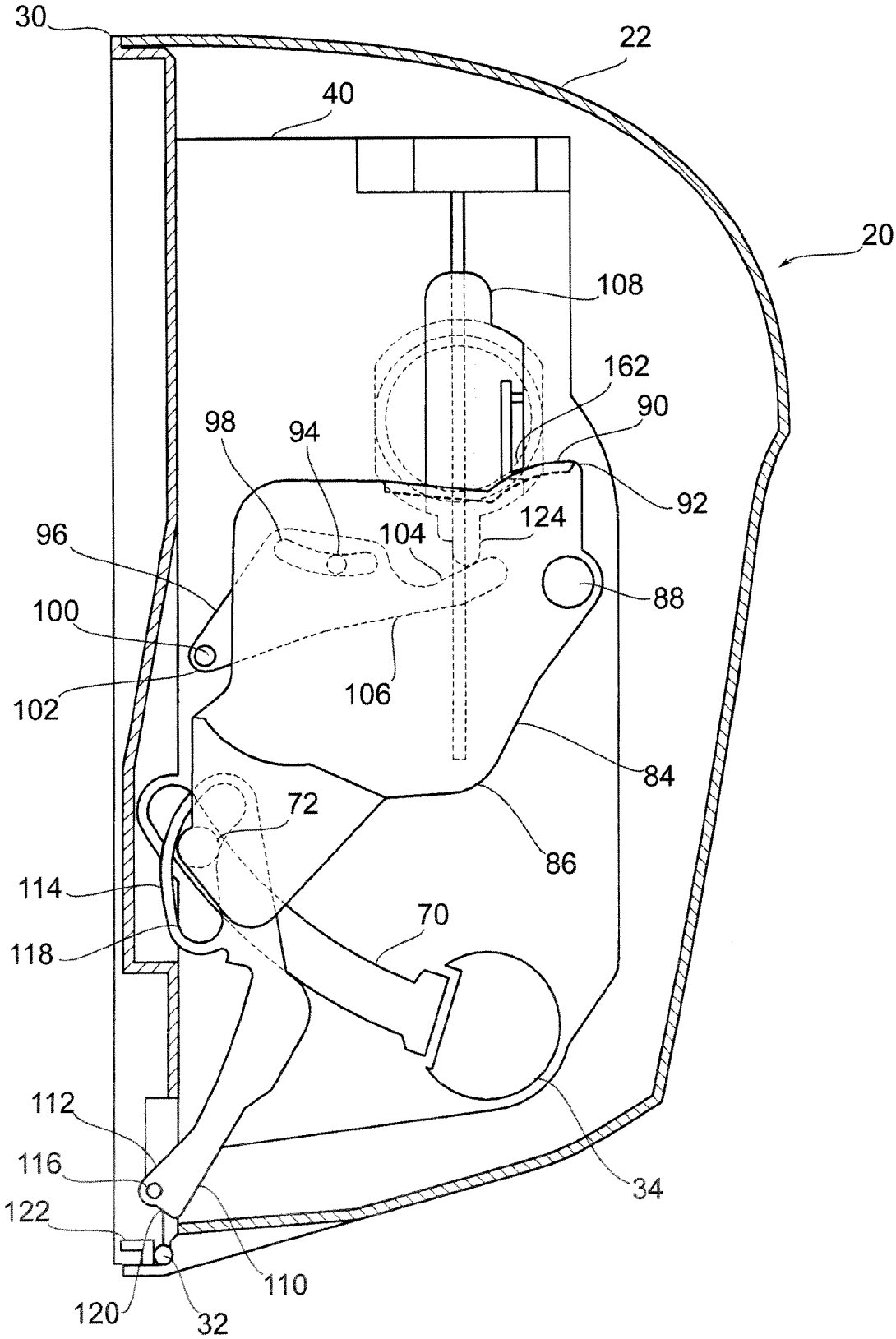
FIG. 6 is a cutaway side view of the right side of one embodiment of the disclosure in a closed and operational position with the primary and secondary rolls removed to show the operational mechanism.
Figure 7:
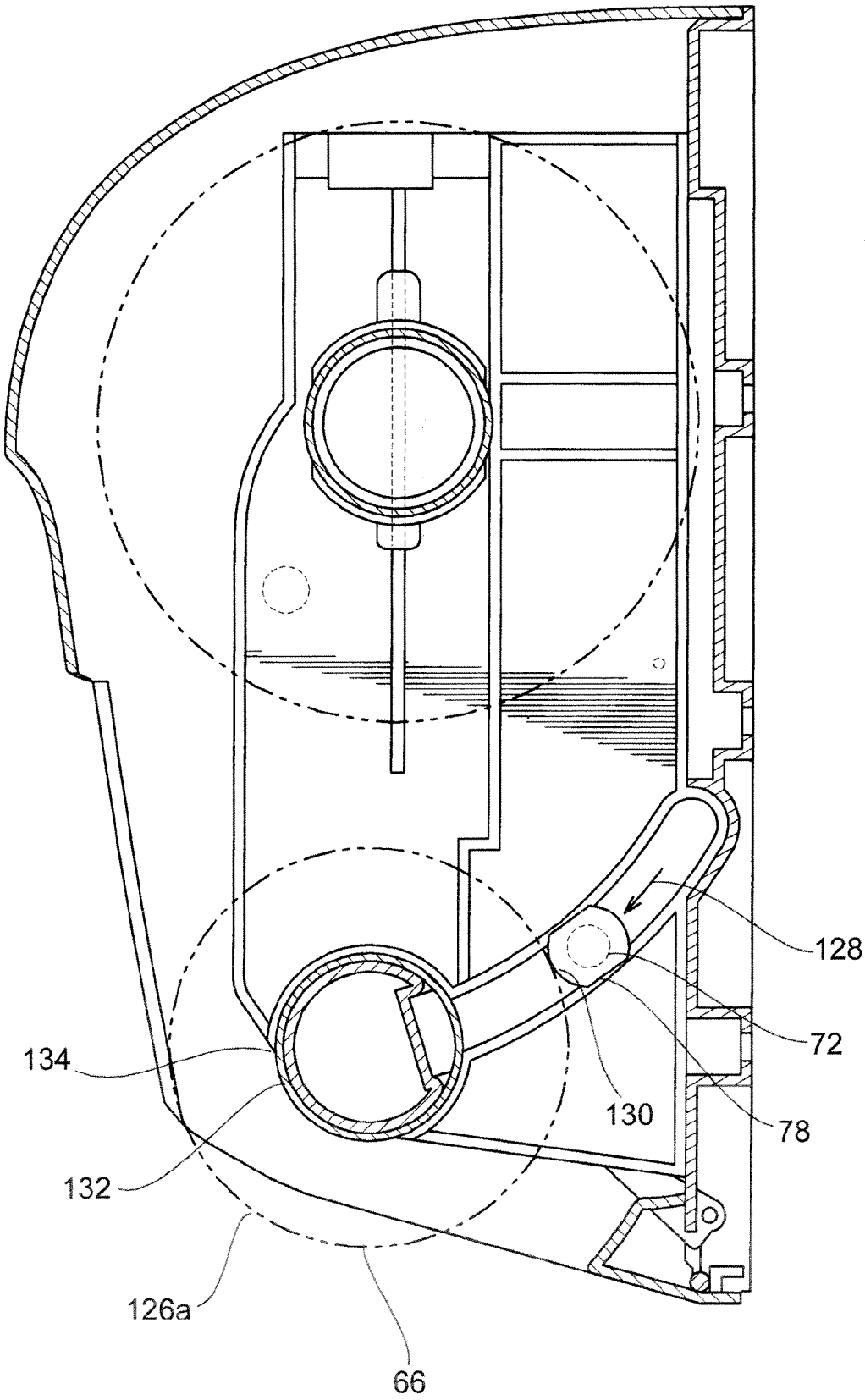
FIG. 7 is a cutaway side view of the left side of one embodiment of the disclosure in a closed and operational position with the primary roll partially utilized.
Figure 14:
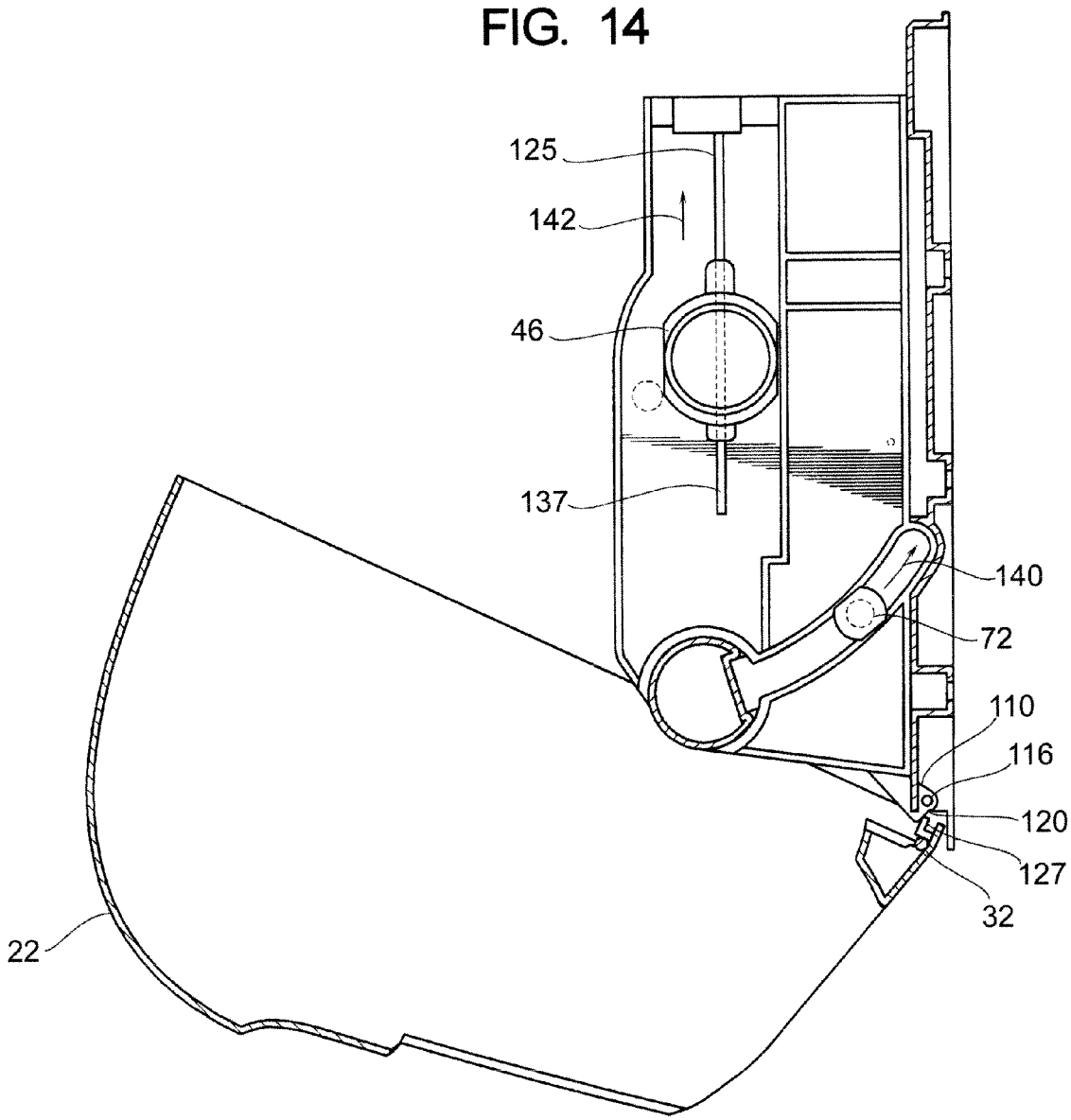
FIG. 14 is a cutaway side view of the left side of one embodiment of the disclosure in a substantially open position with the secondary lifting mechanisms partially reset.
Figure 15:
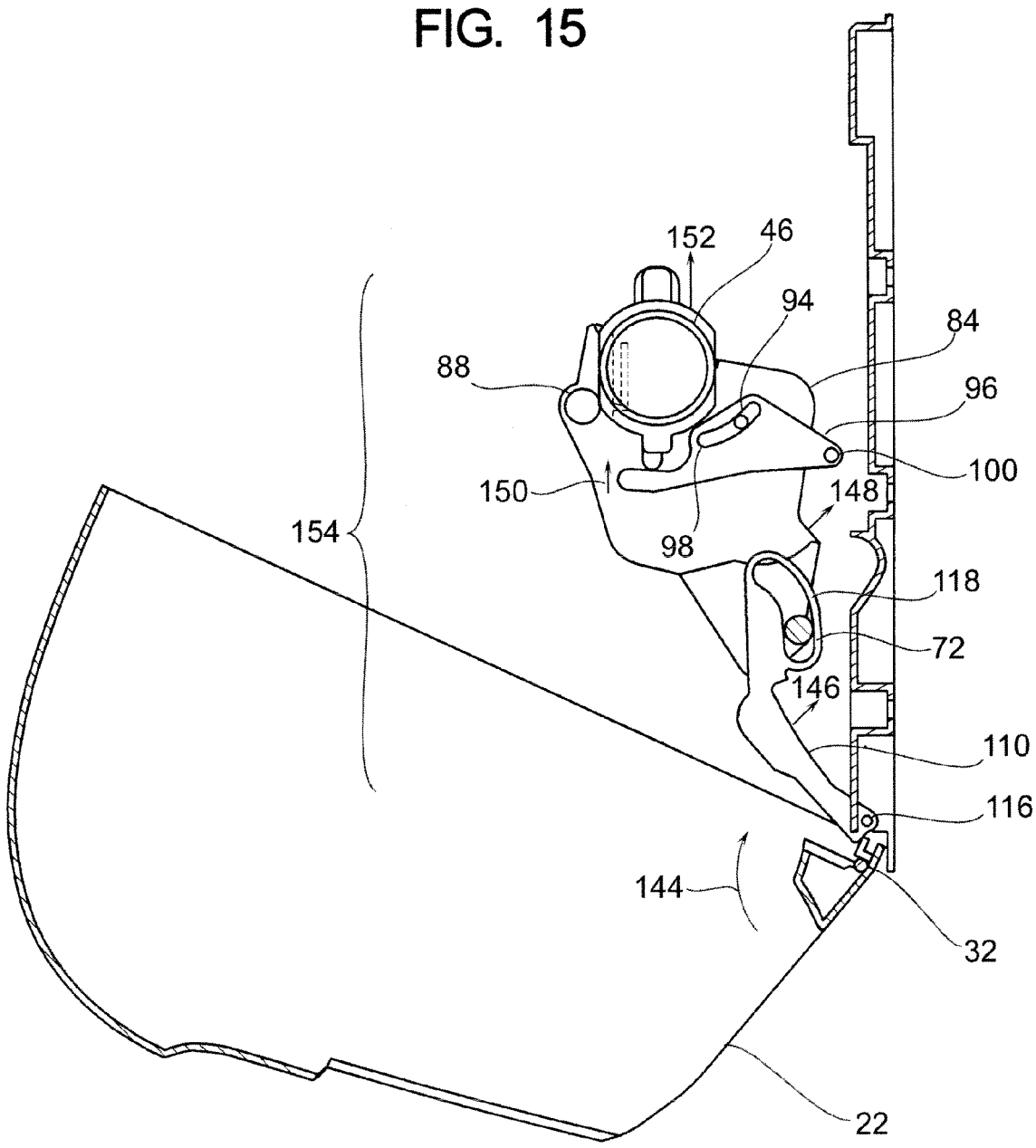
FIG. 15 is a cutaway side view of the left side of one embodiment of the disclosure in a substantially open position with the secondary lifting mechanisms partially reset showing the secondary lifting mechanisms in detail.
Figure 16:
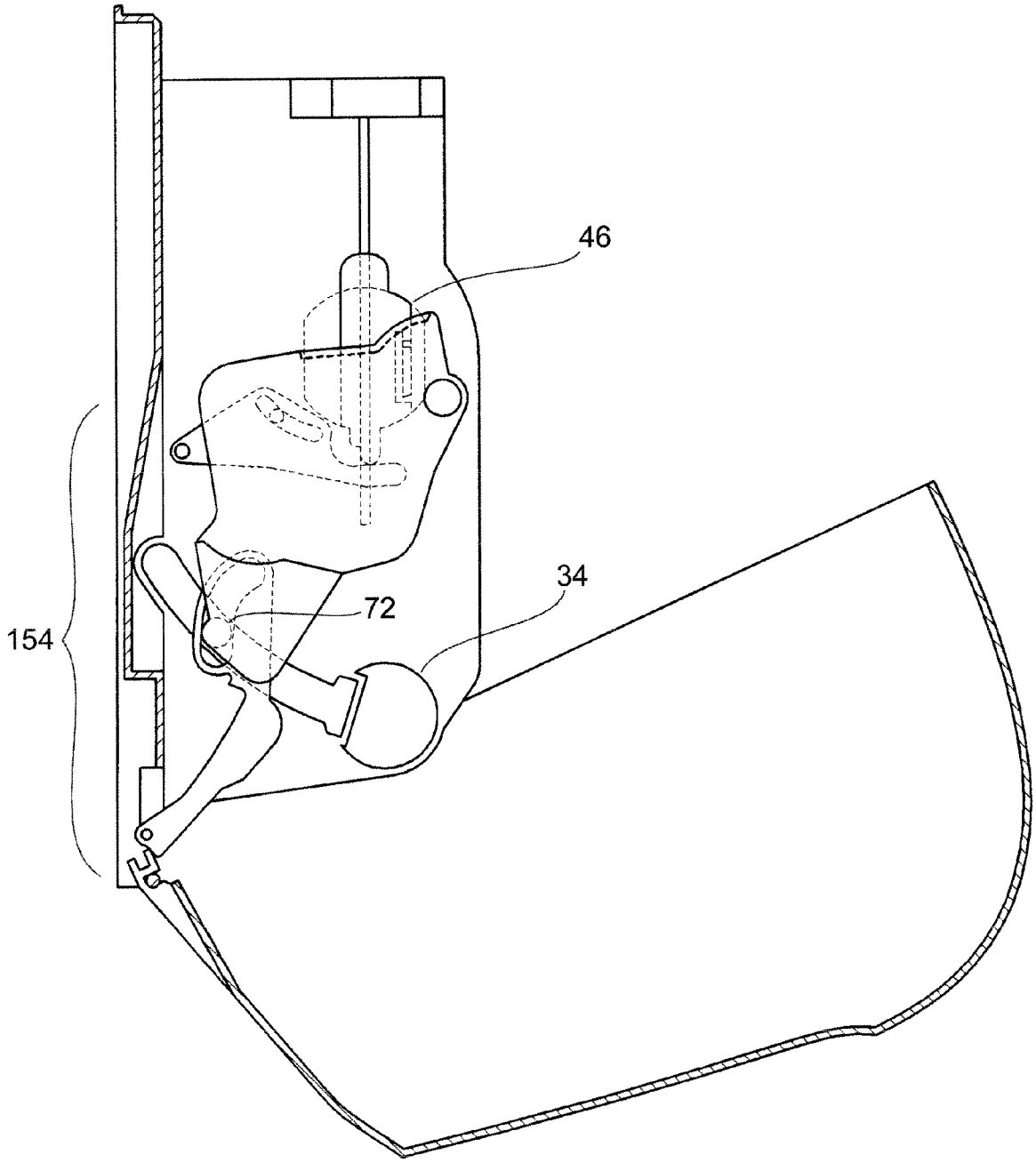
FIG. 16 is a hidden-line side view of the right side of one embodiment of the disclosure in a substantially open position with the secondary lifting mechanisms partially reset.

Now looking at FIG. 6, a cutaway view of one embodiment of the dispenser 20 is shown including the casing 22, and the frame 30. As stated before, as the primary product roll 66 is consumed, the swing arm 72 will slide along channel 70 towards the primary roll support 34. The swing arm 72 extends transversely from the upper member 84 to ride against the primary roll of product. The upper member 84 is shown in a reserve position 86, and is coupled to the lateral extension 40 at an upper member pivot 88. The upper member 84 further includes a cam surface 90 and a seer point 92. These can also be seen in FIG. 3A from a different angle. The upper member 84 in one form also includes a sliding bar 94 extending from the upper member. The sliding bar 94 is coupled to the upper member 84 and engages a lifting member 96 at a channel 98 disposed within the lifting member 96. The lifting member 96 is coupled to the lateral extension 40 at a lifting member pivot 100. The lifting member pivot 100 is substantially at a first end 102 of the lifting member 96. An engagement surface 104 is substantially at the second end 106 of the lifting member 96 and is configured to engage a vertically sliding member 108. The vertically sliding member 108 is coupled through the vertical channel 56 within the lateral extension 40 to the secondary roll support 46. The engagement surface 104 is configured to engage the vertically siding member 108 as to reposition it. A lower member 110 is also disclosed having a first end 112 and a second end 114. The lower member 110 is coupled to the frame 30 at a lower member pivot 116. The lower member 110 could also be coupled to the lateral extension 40. The lower member 110 in one form further comprises a channel 118 configured to engage the swing arm 72. Furthermore, the lower member 110 comprises a reset surface 120 configured to frictionally engage the reset tab 122 of the casing 22 when the casing is substantially opened as is shown in FIGS. 14-16.

Many prior art product roll dispensers require that a person attempting to restock one or more of the product rolls would first need to reset a release (seer) latch which moves the secondary roll from a reserve position to an operational position, and then reset the mechanism which releases the secondary roll, and then replace either the primary or the primary and the secondary roll(s) of product. In one embodiment of this disclosure, as shown in FIG. 6, a dispenser 20 is provided wherein releasing the latching mechanism 24 (see FIG. 1) and opening the casing 22 about the casing pivot 32 engages the reset tab 122 against the reset surface 120 of the lower member pivot 116 as shown in FIG. 14. This force upon the lower member 110 will rotate it away from the primary roll support 34 in direction of travel 140, thus moving the swing arm 72 away from the primary roll support 34 allowing the primary roll to be replaced without necessitating an additional movement of a user, manually repositioning the swing arm 72. Additionally as shown in FIG. 15, the dispenser 20 can be configured such that the movement of the swing arm 72 rotates the upper member 84 about the upper member pivot 88. As the upper member 84 rotates, the sliding bar 94 exerts pressure upon the lifting member 96 rotating it about the lifting member pivot 100. This motion positions the engagement surface 102 against the surface 124 of the vertically sliding member 108. As the engagement surface 104 puts pressure upon the surface 124 of the vertically sliding member 108, it tends to reposition upwardly in direction of travel 150 along the vertical channel 56 (see FIG. 6) to a reserve position As such, if the secondary product roll 64 is substantially consumed, a user could replace it with a new unused roil. At this point the casing 22 could be closed, reengaging the latch mechanism 24 at which point the apparatus is once again ready for use. This reset mechanism would save a considerable amount of time and effort as a single motion of opening the casing 22 repositions the seer mechanism and the secondary roll support 46.

Figure 9:
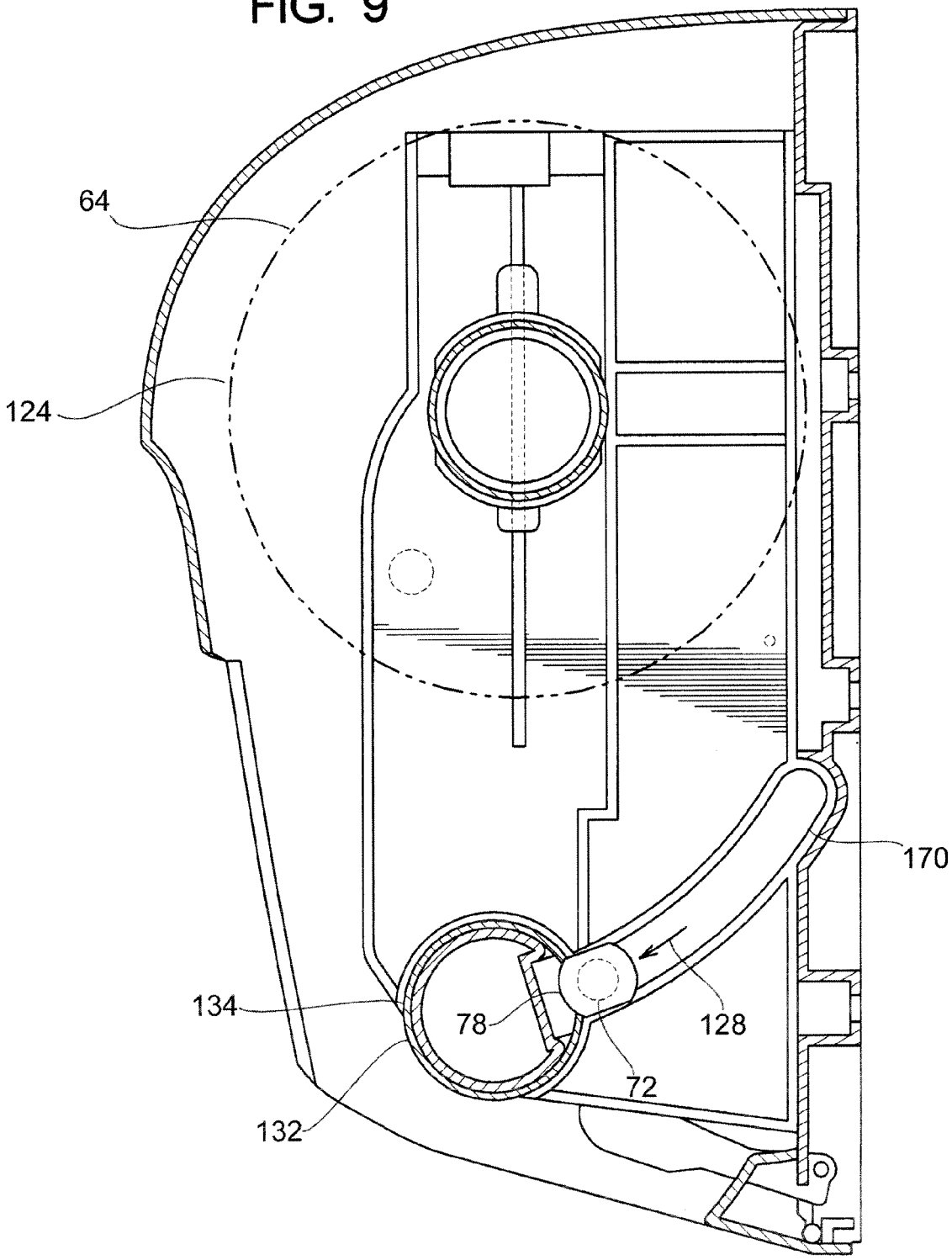
FIG. 9 is a cutaway side view of the left side of one embodiment of the disclosure in a closed and operational position with the primary roll substantially utilized.

Looking at FIGS. 4, 7, 9, 12, 14, and 15, a progression of one embodiment is shown wherein the primary product roll 66 is consumed, the mechanisms are engaged, and upon complete consumption of the primary product roll 66, the casing 22 is opened, resetting the apparatus of the dispenser 20. Looking at FIG. 4, a primary product roll 66 is shown being a substantially recently replaced roll. Similarly, the secondary product roll 64 is in a reserve position 124 and is not available for use by a consumer. Also shown is the swing arm 72 including the engagement portion 78 which is in position to frictionally engage the outer surface 126 of the primary product roll 66. Obviously, friction reducing agents such as Teflon, plastic, a wheel, or other mechanism can also be employed to reduce friction between the swing arm 72 and the outer surface 126 of the primary product roll 66. Looking at FIG. 7, it can be seen how the swing arm 72 moves in the direction of travel 128 as the outer surface 126*a* reduces in diameter when the primary product roll 66 is consumed. As shown, the engagement portion 78 is engaging the outer surface 126*a* of the primary roll 66 at engagement point 130. As shown, the primary product roll 66 includes a core 132 having an outer diameter 134. In one form, the core 132 is a partial or split core, wherein one portion of the core is supported by the primary roll support 34 and any other portions of the core move from the transverse end 136 of the primary roll support 34 as shown in FIG. 2. Thus, as shown in FIG. 9 wherein the secondary product roll 64 is still in the reserve position 124, the swing arm 72 has traveled in the direction of travel 128 along channel 70 beyond the outer diameter 134 of the core 132. The majority of the swing arm 72 would not move beyond the outer diameter 134 of the core 132, however, the engagement portion 78 could move beyond the outer diameter 134.

Figure 12:
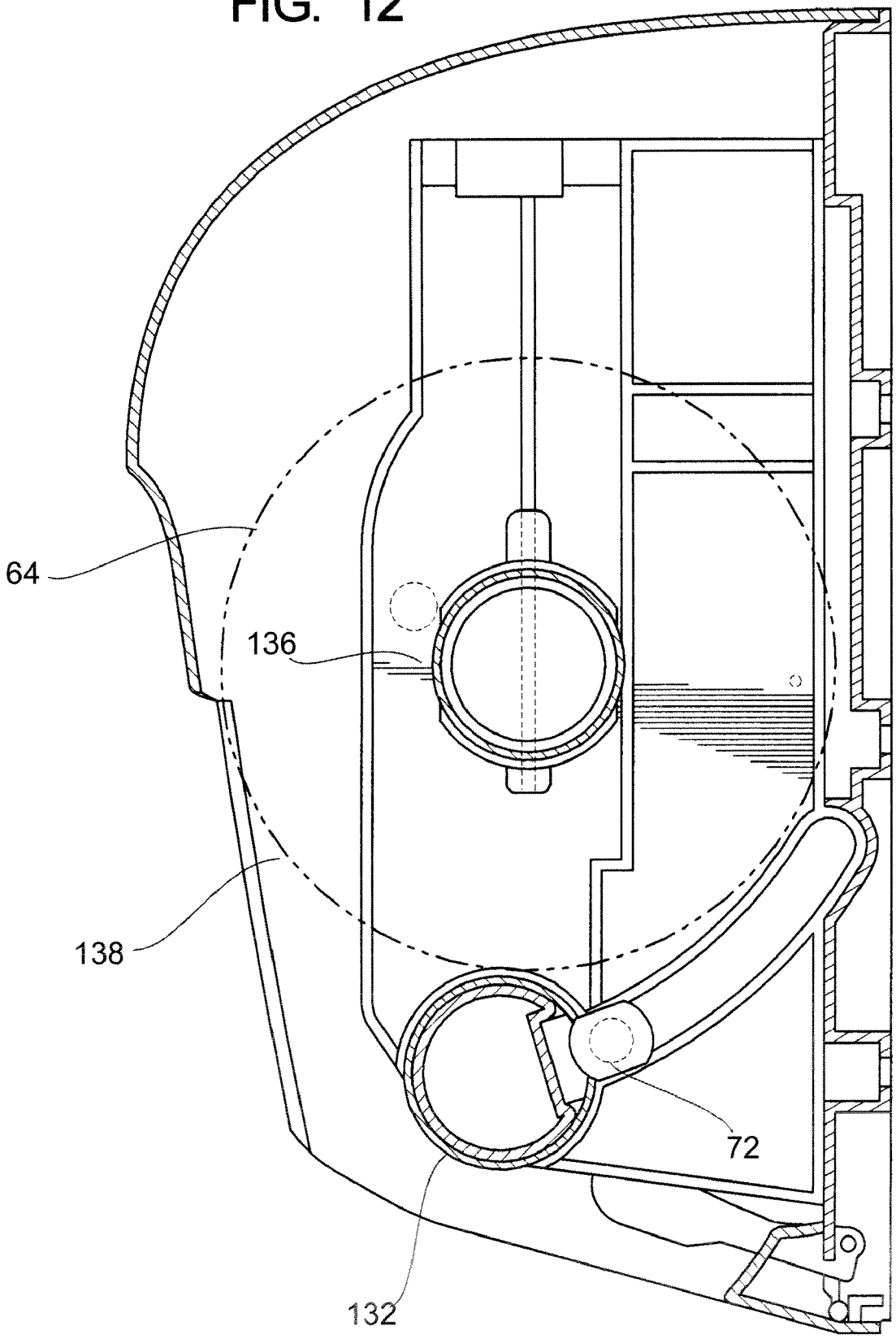
FIG. 12 is a cutaway side view of the left side of one embodiment of the disclosure and a closed and operational position with the primary roll removed and the secondary roll in a position to be utilized.

As the primary product roll 66 of one embodiment of the disclosure is substantially consumed, the secondary roll 64 is released, and the secondary roll support 46 slides along the vertical channel 56 from the reserve position 124 as shown in FIG. 9 to an operational position 136 as shown in FIG. 12. In this position, a consumer would have access to the outer surface 138 of the secondary product roll 64 through the opening 23 as further shown in FIG. 1. Thereafter the secondary product roll 64 can be consumed.

Obviously, at this stage it would be inconvenient to replace a primary product roll core 132 with a new roll even after the casing 22 were opened as the secondary product roll 64, the secondary roll support 46, and the swing arm 72 could interfere with such action. Thus, an embodiment is disclosed wherein as shown in FIG. 14, as the casing 22 is opened about pivot point 32, the reset tab 122 engages the reset surface 120 of the lower member 110, which forces the lower member 110 to pivot about the lower member pivot 116 and repositions the swing arm 72 in the direction of travel as shown at 140. In one embodiment, opening the casing 22 as described also repositions the secondary roll support 46 from an operational position 137 to a reserve position 125 in the direction indicated at 142.

The specific sequence as shown in FIG. 15, of one embodiment of the disclosure, is that as the casing 22 rotates about case pivot 32 in the direction as indicated at 144, pressure is put upon the lower member 110. The pressure exerted by the casing 22 against the lower member 110 rotates the lower member 110 about lower member pivot 116 in the direction as indicated at 146. This rotation and movement of the lower member 110 exerts force against the swing arm 72 by way of the channel 118. As the swing arm 72 is connected to the upper member 84, this force tends to rotate the upper member 84 about the upper member pivot 88 in the direction as indicated at 148. This rotation of the upper member 84 about the upper member pivot 88 exerts force against the lifting member 96 by way of the sliding bar 94 engaging the surfaces of the channel 98. The sliding bar 94 is coupled to the upper member 84. This force against the lifting member 96 will rotate the lifting member 96 about lifting member pivot 100 in the direction as indicated at 150. This exerts force from the lifting member 96 upon the secondary roll support 46 as previously discussed biasing the secondary roll support 46 in the direction as indicated at 152. Thus, the two operations of the reset mechanism 154 are achieved. These operations are: repositioning the swing arm 72 such that a new roll can be placed upon the primary roll support with a minimum of effort and also the secondary roll support 46 is moved from an operational position 136 to a reserve position 124 as shown in FIG. 14. Should the secondary product roll 64 need to be replaced, that can easily be achieved at this point.

Figure 5:
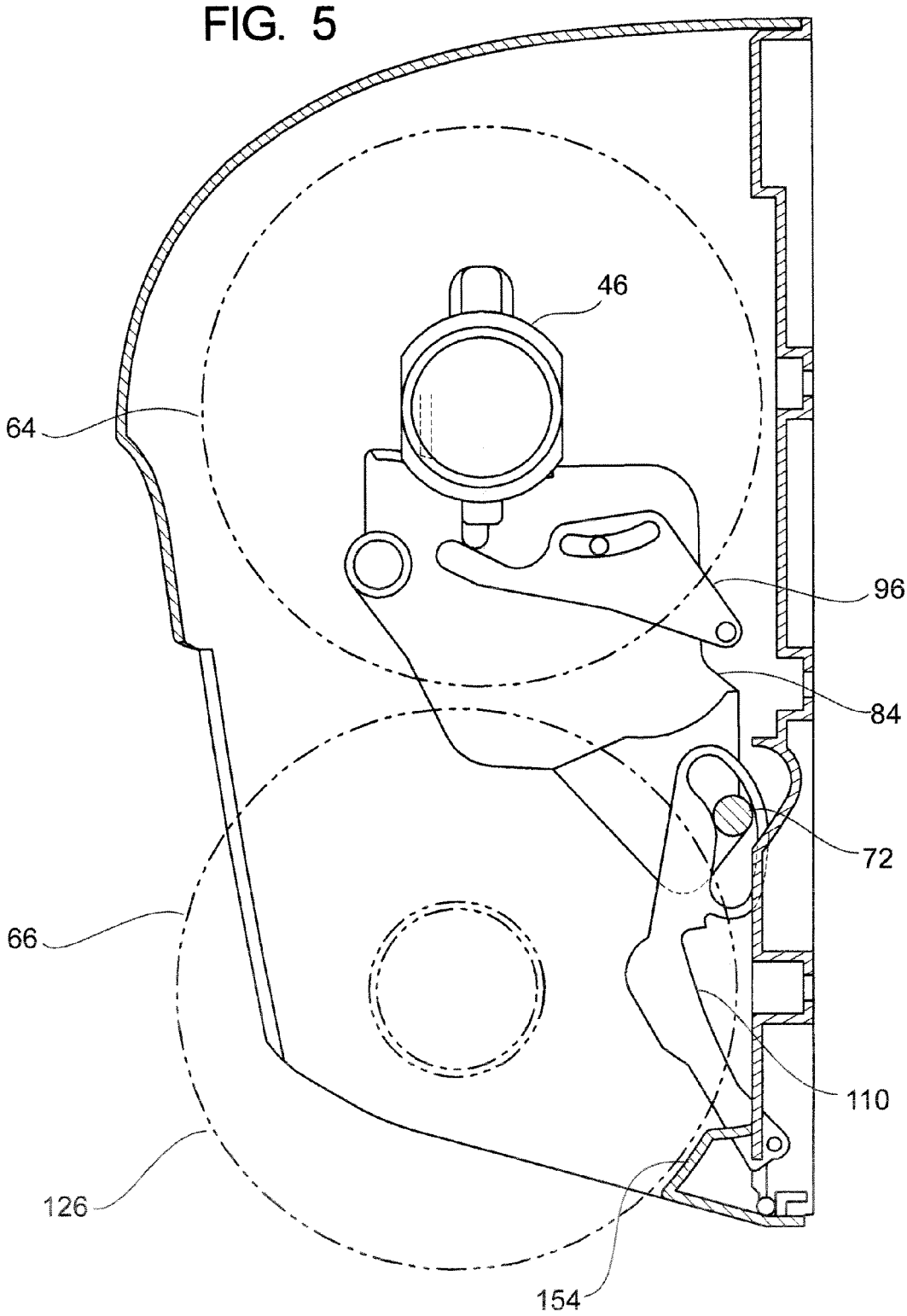
FIG. 5 is a cutaway view of the left side of one embodiment of the disclosure in a closed and operational position showing the secondary lifting mechanism.
Figure 8:
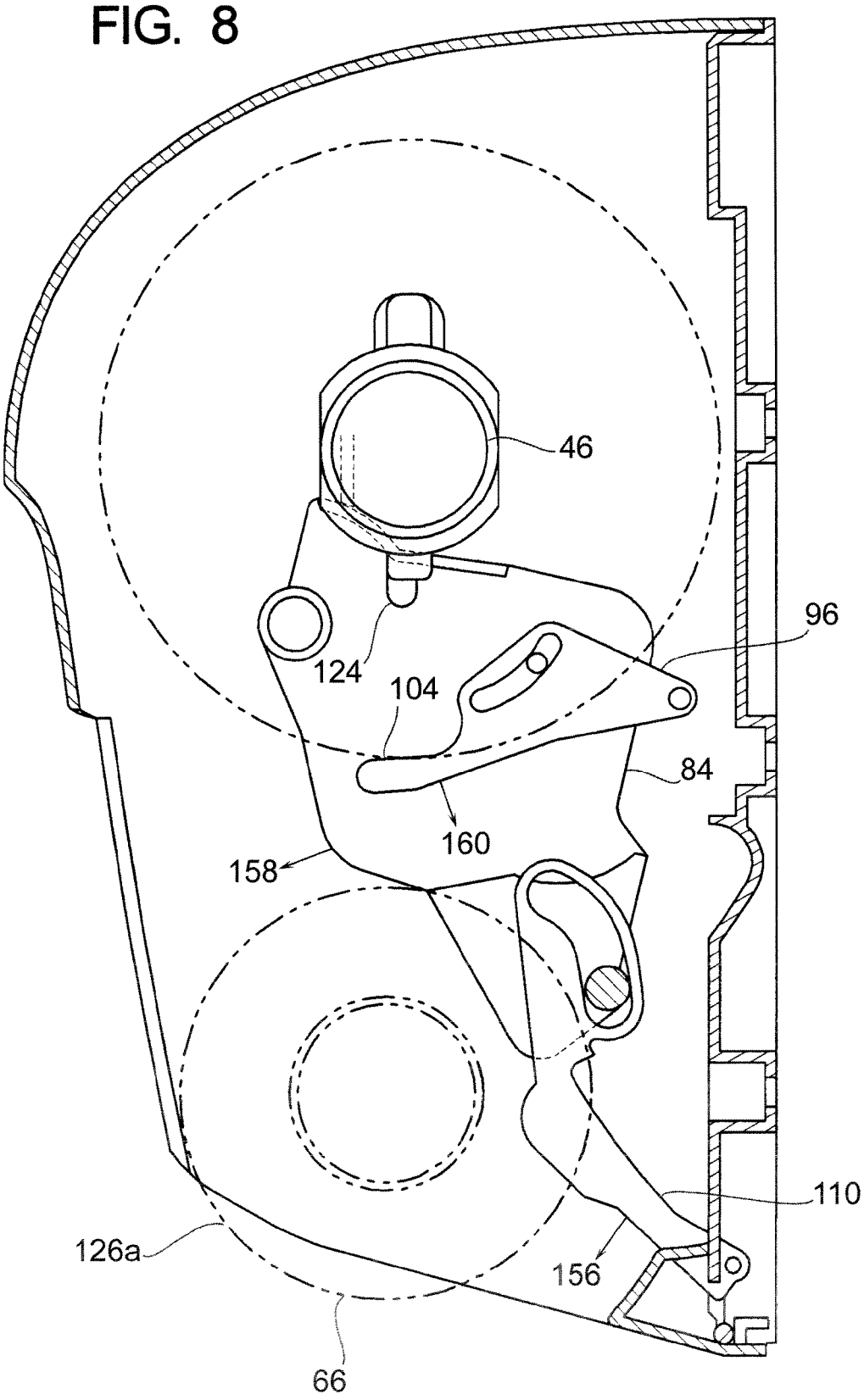
FIG. 8 is a cutaway side view of the left side of one embodiment of the disclosure in a closed and operational position with the primary roll partially utilized showing the secondary lifting mechanism.
Figure 10:
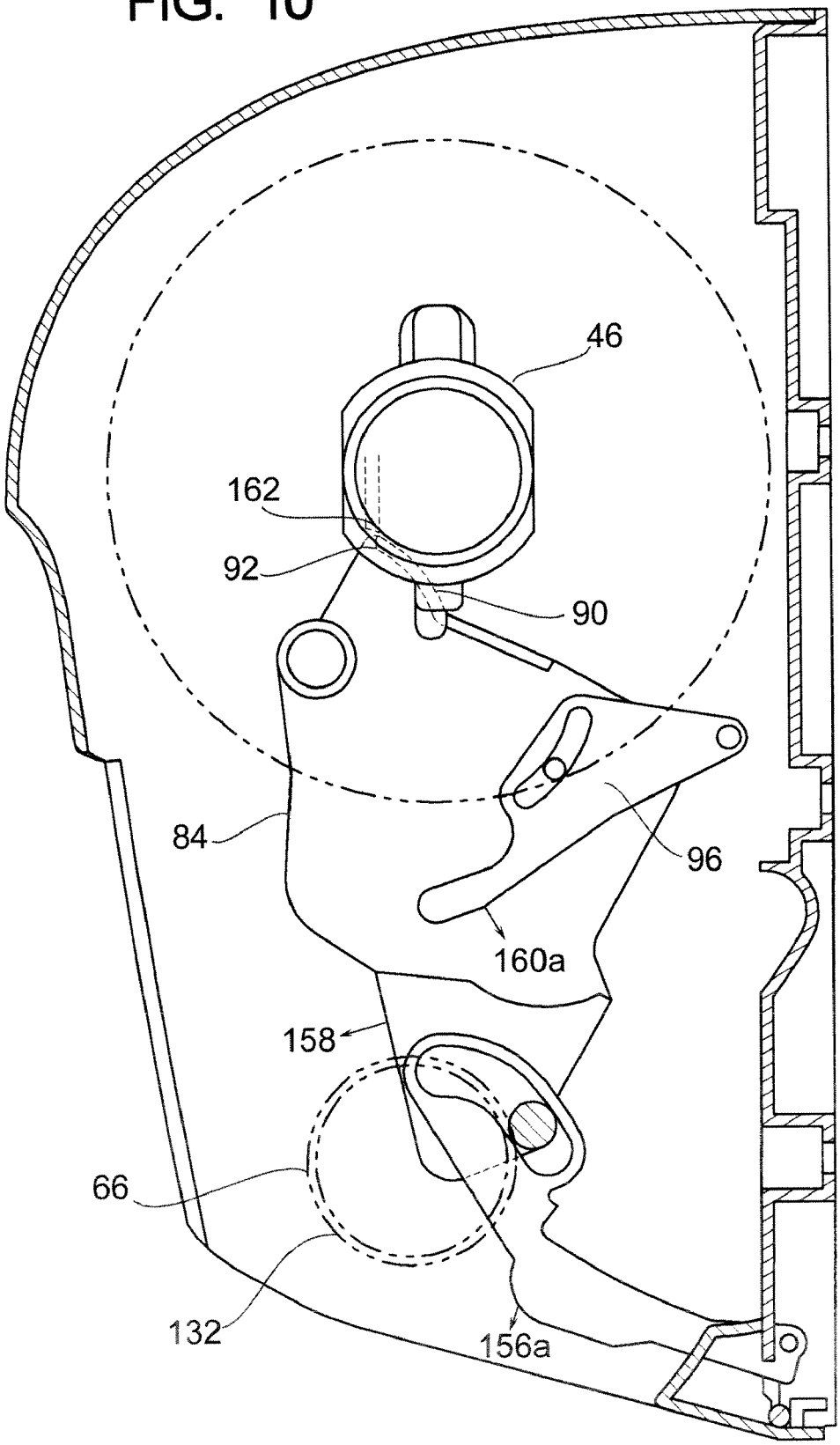
FIG. 10 is a cutaway side view of the left side of one embodiment of the disclosure in a closed and operational position with the primary roll substantially removed showing the secondary lifting mechanism.

It is also conceived that whereas it may be beneficial to provide the primary product roll with a split or partial core, it may also be desirable to provide the secondary product roll 64 with a full-size core Now looking at FIGS. 5, 8, 10 it can be seen how the same sequence is achieved in views showing the reset mechanism 154 of one embodiment. Once again, FIG. 5 shows a primary roll 66 as a substantially new roll wherein the outer surface 126 comes very close to its maximum position against the frame at the position indicated at 154. The secondary roll support 46 is in its uppermost reserve position. The lower member 110 is shown positioned very near the frame 30 and the upper member 84 is in its position to engage the secondary support 46. Now moving on to FIG. 8 it can be seen how the outer surface 126*a* of the primary roll 66 has a substantially reduced diameter and the lower member 110 has pivoted in a direction as indicated at 156. Thus, in turn the upper member 84 has pivoted in the direction as shown at 158, the lifting member 96 has pivoted in direction as shown at 160 wherein the engagement surface 104 of the lifting member 96 is no longer in contact with the surface 124 of the secondary roll support 46. The seer point 92 has not yet passed beyond the seer latch 162. Moving on to FIG. 10, the primary roll 66 is substantially consumed exposing the core 132 and the lower member 110 has rotated in direction 156*a* to its furthest position and the upper member 84 has rotated its furthermost position as indicated in direction 158 and thus, the lifting member 96 has rotated to its furthest position as indicated in direction 160*a*. Looking closely at the point where the upper member 84 comes in contact with the secondary roll support 46 it can be seen that the seer latch 162 is still in contact with the cam surface 90 of the upper member 84. In one embodiment, as the upper member 84 rotates such that the cam surface 90 is no longer in contact with the seer latch 162, to be more specific the seer point 92 has passed beyond the edge of the seer latch 162, it can be seen how the secondary roll support 46 will then drop down, exposing the secondary product roll 64 through the opening 23 to an operational position.

Figure 11:
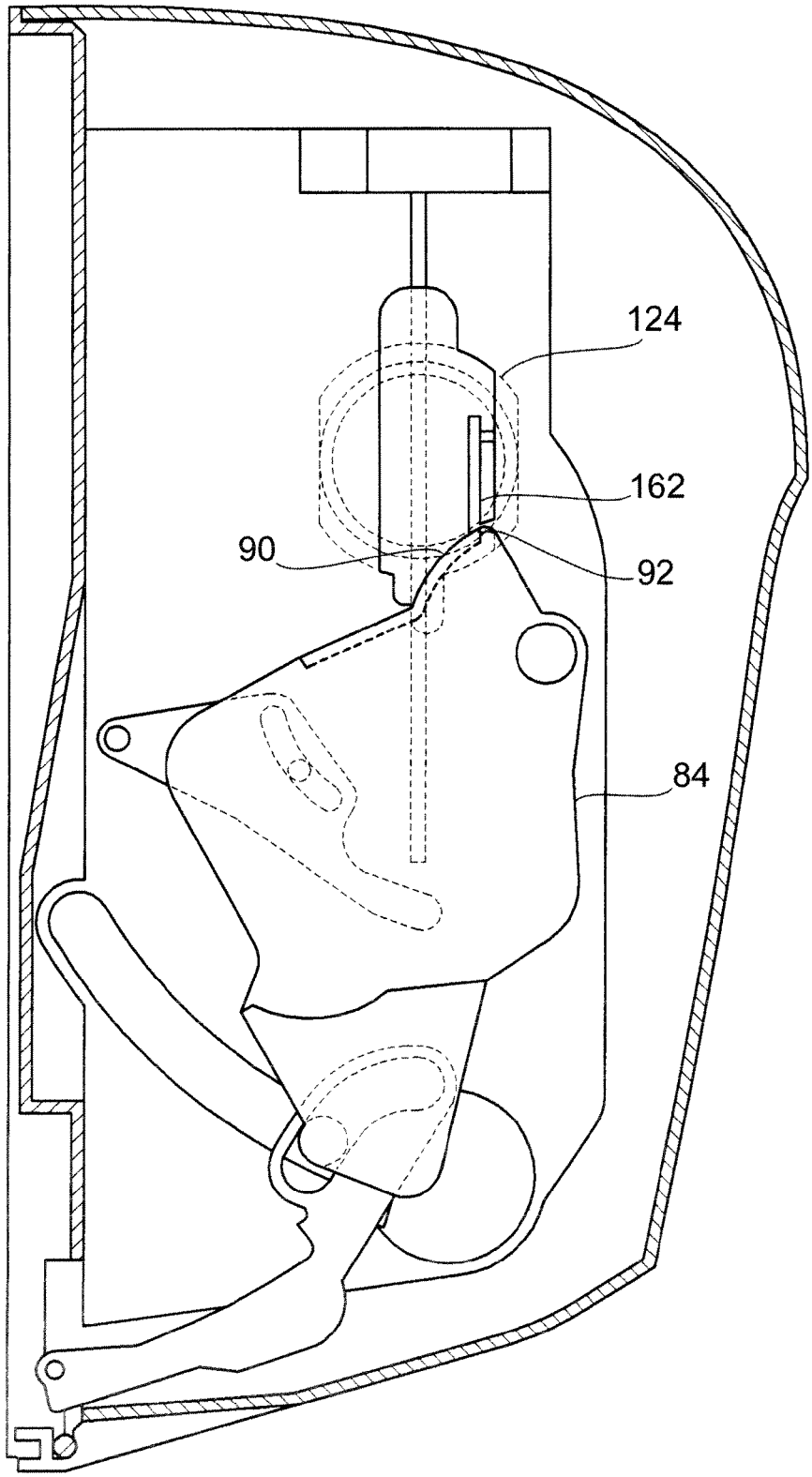
FIG. 11 is a cutaway side view of the right side of one embodiment of the disclosure in a closed and operational position with the primary roll substantially utilize.
Figure 13:
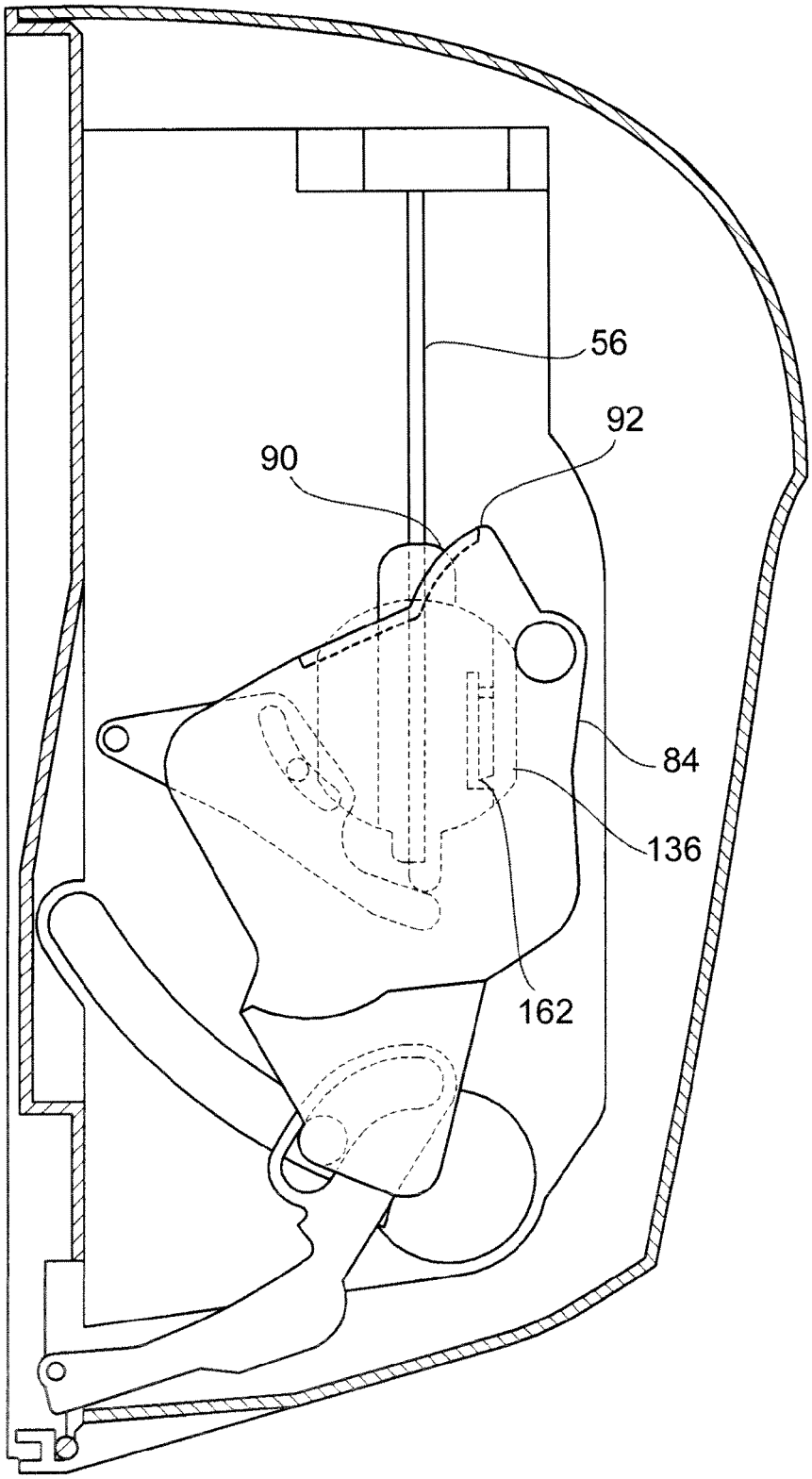
FIG. 13 is a cutaway side view of the right side of one embodiment of the disclosure in a closed and operational position with the primary roll removed and the secondary roll in position to be utilized.

This particular embodiment of a seer mechanism can further be seen in FIGS. 11, 13 wherein at FIG. 11 the primary roll is not completely consumed and the secondary roll is still in its reserve position. In FIG. 13 however, the seer latch 162 is no longer in contact with the cam surface 90 and the upper member 84 is rotated such that the seer point 92 has passed beyond the seer latch 162 and has dropped along the vertical channel 56 from the reserve position 124 to the operational position 136.

Now looking at FIG. 16, the reset series as previously discussed is shown from the left transverse side showing once again the reset mechanism 154. As has been previously discussed, as the casing 22 is rotated to an open position, forces are exerted upon the lower member and other associated portions of the reset mechanism 154 to reposition the swing arm 72 to a position furthest from the primary roll support 34 and in one embodiment, substantially simultaneously reposition the secondary roll support 46 from the operational position 136 to the reserve position 124.

Now looking at FIG. 3A, a detail view of the release system 164 in one form can be seen. As previously discussed, the vertical sliding member 108 rides substantially within the vertical channel 56 which allows it to move vertically, but hinders any rotation or lateral or transverse motion. The seer latch 162 in this embodiment is comprised as a portion of the vertically sliding member 108. As can be seen, the seer latch 162 comprises a first end 164 and a second end 166. Furthermore, the seer latch 162 comprises a back side or surface 168 and generally consists of a spring portion 170. The second end 166 of the spring portion 170 rides along the cam surface 90 of the upper member 84. As the primary product roll is consumed, the upper member 84 is caused to rotate about the upper member pivot 88 in the direction indicated at the arrow 158. As can be seen, the radius 172 between the center of the upper member pivot 88 and the cam surface 90 allows the second end 166 to ride long the cam surface 90 with no substantial movement of the vertical sliding member 108. Once, however, the upper member 84 rotates such that the second end 166 of the seer latch 162 passes the seer point 92, the entire secondary roll support 46 is released downward from the reserve position to an operational position.

In this embodiment, one advantage of the spring portion 170 is that as the casing is opened, resetting the device as previously discussed, the upper member 84 tends to rotate prior to repositioning the vertically sliding member 108. Thus, as the vertically sliding member 108 is repositioned upwardly along the vertical channel 56, the spring portion 170 deforms and the back surface 168 rides against the transverse inward edge 174 of the cam surface 90. Once the second end 166 passes vertically beyond the cam surface 90, the spring portion 170 reforms to its original orientation and as the vertically sliding member is released. The second end 166 once again engages the cam surface 90 and the process begins again.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

We claim:

1. A paper product dispenser for dispensing toilet paper rolls comprising a primary roll having an outer surface and a secondary roll, wherein the dispenser comprises:

a) a frame comprising a face side;

b) a lateral extension having a face side, a back side, and a first end, the lateral extension coupled at the first end to the face side of the frame;

c) a primary roll support fixedly coupled to the lateral extension and extending transversely from the face side of the lateral extension, operatively configured to support a primary roll of product by extending into a central portion of the primary roll of product;

d) a secondary roll support movably coupled to a vertical channel disposed on the lateral extension wherein the secondary roll support extends transversely from the face side of the lateral extension and is operatively configured to extend into a central portion of the secondary roll of product;

e) wherein the secondary roll support comprises a release latch, and f) a swing arm extending transversely from the lateral extension wherein the swing arm is configured to engage the outer surface of the primary roll positioned upon the primary roll support and reposition toward the center of the primary roll of product as the primary roll of product is consumed.

2. The paper product dispenser of claim 1 wherein the swing arm is operatively configured to be repositioned from a first position to a reserve position, followed by repositioning the secondary roll support from a first position to a reserve position, configured to allow a user access to the secondary roll of product.

3. The paper product dispenser of claim 1 wherein the swing arm is rotatably coupled to the frame at a first end of a lower member via a lower member pivot and the lower member comprises a channel substantially at a second end of the lower member configured to slidably engage the upper member wherein the channel of the lower member directly engages the swing arm.

4. The paper product dispenser of claim 3 wherein the swing arm is coupled to the frame and is configured to engage the outer surface of the primary roll of product while the primary roll is being utilized; and the swing arm is further coupled to a casing and operatively configured to reset to a first position when the casing is opened.

5. The paper product dispenser of claim 4 wherein the casing is rotatably attached to the frame at a casing pivot and further comprising a repositioning tab operatively configured to engage a repositioning surface on the first end of the lower member when the casing is opened to a substantially fully open position, wherein pressure against the repositioning surface of the lower member by the repositioning tab will rotate the lower member about the lower member pivot which will reposition the swing arm from a reserve position to the first position.

6. The paper product dispenser of claim 5 wherein rotating the lower member about the lower member pivot will in turn rotate an upper member about an upper member pivot and thus rotate a lifting member about a lifting member pivot which will in turn engage an engagement surface of the lifting member against a vertically sliding member repositioning the secondary roll support into a reserve position.

7. The paper product dispenser of claim 1 further comprising an upper member rotatably coupled to the back side of the lateral extension and comprising a cam surface slidably engaging the release latch, the upper member comprising a cam surface and a seer point which are configured to slidably engage a seer latch while the primary product roll is not substantially consumed.

8. The paper product dispenser of claim 1 wherein the swing arm extends transversely from an upper member through a surface defining a channel disposed upon the lateral extension.

9. The paper product dispenser of claim 1 wherein the swing arm further comprises an engagement portion operatively configured to engage the outer surface of the primary product roll until the primary product roll is substantially consumed at which point a seer latch is released and the secondary product roll is repositioned in a usable position.

10. The paper product dispenser of claim 9 wherein the swing arm further comprises the engagement portion operatively configured to release a seer latch and thus releases a vertically sliding member and thus releases the secondary roll product roll to an operational position only when the primary roll is completely utilized.

11. The paper product dispenser of claim 1 wherein the secondary roll support further comprises:

a) a secondary roll support base having a first face comprising an extension substantially configured to fit within a partial core of the product roll and support the secondary product roll; and b) wherein the secondary roll support base further comprises a second face configured to slidably engage the face side of the lateral extension.

12. The paper product dispenser of claim 1 further comprising a lifting member coupled at a first end to a lifting member pivot which extends from the lateral extension, the lifting member comprising an engagement surface substantially positioned at the second end of the lifting member which is operatively configured to slidably engage a vertically sliding member, and comprises a surface defining a channel positioned between the lifting member pivot and the engagement surface operatively configured to engage in a sliding bar extending transversely from the upper member.

13. A paper product dispenser for dispensing product disposed on a plurality of hollow cores wherein the dispenser comprises:

a) a frame;

b) a casing pivotally coupled to the lower portion of the frame;

c) a primary roll support fixedly coupled to the frame;

d) a secondary roll support movably coupled to the frame;

e) a seer mechanism coupled to the secondary roll support and operatively configured to reposition the secondary roll support from a reserve position to a usable position spaced from the reserve position when a primary roll of product is substantially consumed; and f) wherein the seer mechanism is coupled to the casing and operatively configured to reset the secondary roll support from the usable position to the reserve position when the casing is substantially opened.

14. The paper product dispenser as disclosed in claim 13 further comprising:

a) a swing arm coupled to the seer mechanism and configured to engage the outer surface of the primary roll while the primary roll is being utilized and operatively configured to engage the seer mechanism and release the secondary roll support when the primary roll is substantially consumed; and b) a lower member coupled to the frame and engaging a portion of the casing configured to reposition the swing arm when the casing is substantially opened.

* * * * *